US006336838B1

(12) United States Patent
Levy et al.

(10) Patent No.: US 6,336,838 B1
(45) Date of Patent: Jan. 8, 2002

(54) AUTOMATIC TOW RELEASE SYSTEM FOR MODEL AIRCRAFT

(76) Inventors: Alejandro Velasco Levy; Ildiko Palyka, both of P.O. Box 109, Upton, NY (US) 11973

( * ) Notice: Subject to any disclaimer, the term of this patent is extended or adjusted under 35 U.S.C. 154(b) by 0 days.

(21) Appl. No.: 09/413,199

(22) Filed: Oct. 5, 1999

(51) Int. Cl.[7] ..... A63H 27/00; A63H 27/14
(52) U.S. Cl. ..... 446/34; 446/63
(58) Field of Search ..... 446/34, 45, 61, 446/63, 64, 429, 247; 124/4, 5

(56) References Cited

U.S. PATENT DOCUMENTS

| | | | | |
|---|---|---|---|---|
| 2,638,708 A | * | 5/1953 | Grow | |
| 3,999,328 A | | 12/1976 | Schroeder | |
| 4,655,719 A | | 4/1987 | Sunray | 446/59 |
| 4,863,412 A | | 9/1989 | Mihalinec | 446/66 |
| 5,383,805 A | | 1/1995 | Tsai | 446/66 |
| 5,433,641 A | * | 7/1995 | Rudell et al. | 446/429 |

* cited by examiner

*Primary Examiner*—D. Neal Muir

(57) ABSTRACT

An automatic tow release system for model aircraft launched with the help of a tow line (12) which has novel means for continuously and automatically adjusting the climb angle of the fuselage and automatically releasing the tow line (12) when the aircraft reaches a predetermined climbing position. The tow release system comprises a primary (16) and a secondary (18) control string, a connecting body (20), a primary (42) and a secondary (44) connecting means between the connecting body (20) and the aircraft, and a release promoting means. The release promoting means is a feature of the particular design of the tow release system. The control strings (16, 18) are attached to the tow line (12) at one end and to the connecting body (20) at the other end. The connecting body (20) is demountably connected to the aircraft during the tow through the primary (42) and secondary (44) connecting means, respectively. At the beginning of the take-off, the pulling force of the tow line (12) is conveyed to the aircraft mostly through the primary control string (16). During the climb, the tension is gradually transferred to the secondary control string (18). The release promoting means is activated and the primary (42) and secondary (44) connecting means are disengaged upon the complete transfer of the pulling force from the primary (16) to the secondary control string (18), whereby the tow line is released. The timing of the release depends on some user-adjustable geometric parameters of the tow release system. The user can set the system to release the tow line when the aircraft is in position for a slow gliding flight or for a fast looping flight.

9 Claims, 7 Drawing Sheets

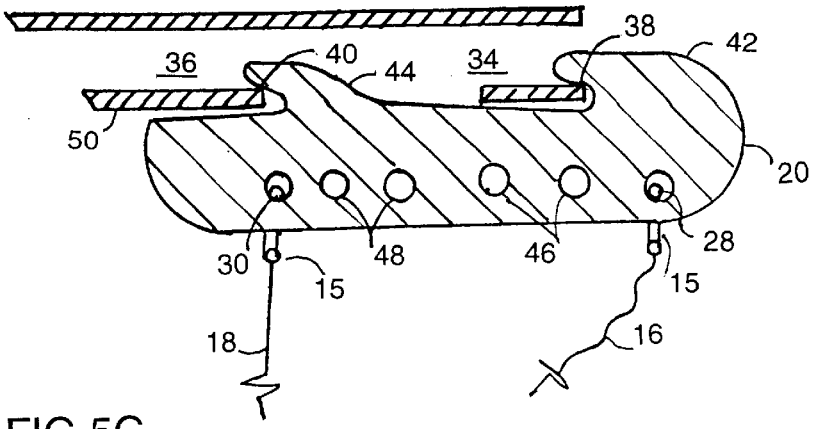
FIG.5C
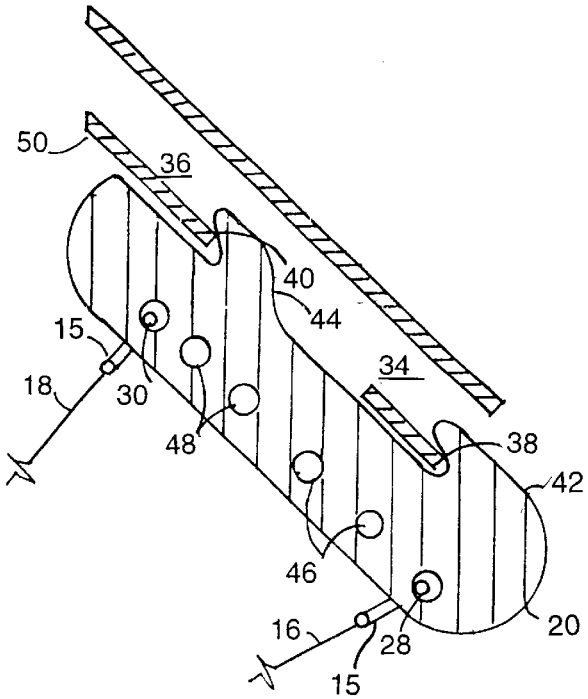
FIG.5B
FIG.5A
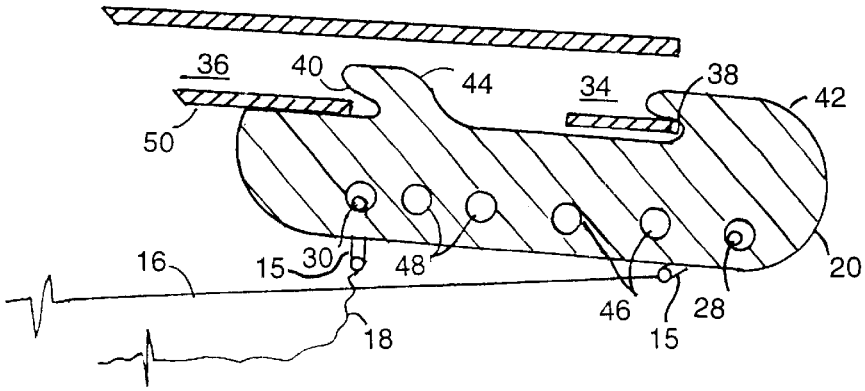

AUTOMATIC TOW RELEASE SYSTEM FOR MODEL AIRCRAFT

CROSS-REFERENCE TO RELATED APPLICATIONS

On model aircraft with no radio control, this invention is recommended to be used in combination with the automatic pilot system described in our co-pending U.S. patent application Ser. No. 09/413,200, filed Oct. 5, 1999. On molded plastic foam models, the impact-absorbing wing connection system, described in our co-pending U.S. patent application Ser. No. 09/413,201, filed Oct. 5, 1999, can also be beneficial. The combination of these three systems produces a model glider that has no mechanically moving parts, yet it is able to take-off, fly, and land in a user-selected pattern, and it is sturdy and durable.

BACKGROUND OF THE INVENTION

This invention relates to model airplanes and other flying toys, which are launched with the help of a tow line, specifically to a tow release system that automatically disengages the tow line upon detecting that the aircraft has reached a predetermined climbing position and height.

Many flying toys, and model airplanes are launched with the help of a tow line that is connected to the airplane through a hook. The tow line can be an extended elastic band, which propels the airplane to fly upon contraction. Alternatively, a non-elastic tow line can be driven by a winch. In either case, the tow line is released when the airplane reaches a certain climbing position. The quality of the free flight that follows is strongly influenced by the timing of the release and the climbing angle of the fuselage at the moment of the release.

Radio-controlled gliders are frequently launched by a tow line that is a combination of a long elastic band and an even longer tow string. One end of the tow line is attached to a ground-stake, while the other end terminates in a small tow ring. For take-off, the tow ring is attached to a hook on the bottom of the glider's fuselage. This towing system, commonly known as "High Start", can tow a glider to several hundred feet in height before releasing it for a free flight. During the tow, the pilot must continuously adjust the elevator position on the glider in order to avoid an excessive climb angle that would result in a wing stall or a premature release of the tow line. When the pilot decides to release, he or she first has to set the elevator position so that it forces the glider into a dive for a few seconds. This reduces the tension in the tow line. Then, he or she has to tilt the glider's nose up, in order to make the tow ring slide off the hook.

Other radio-controlled gliders found in the prior art utilize a tow line which is propelled by a closed-loop string which, in turn, is pulled by a winch. This tow system requires an electric motor, a speed controller, and a large electric battery. It has the advantage of being able to tow the glider at a steady speed, but the pilot still has the responsibility to continuously adjust the climb angle in order to avoid a premature release or a wing stall. To release the tow ring from the tow hook, the pilot has to execute the same sequence of radio-controlled flight maneuvers, as described above.

For highly experienced radio-control pilots, performing these sensitive maneuvers is part of the fun. For less adept pilots or students, however, a misguided take-off can cost a sometimes very expensive model airplane. A release system, that automatically detects the appropriate release time and disengages the tow line in a reliable fashion, could be of great value for such users, since it would let them concentrate on piloting the glider in free flight, while they are acquiring the necessary skills for complete control.

An even more important use of an automatic tow release system would be for the launching of model gliders, toy airplanes, and other flying toys that do not have radio control. Such models can provide inexpensive and educational entertainment for everyone, regardless of economical status or flying experience.

To the best of our knowledge, there has been no automatic tow release system presented in prior art that releases the tow line at any user-determined climbing position and does so in a reproducible and reliable manner.

Small gliders are frequently launched with a hand-held rubber band, hooked to a simple notch on the lower part of the fuselage, as seen in U.S. Pat. Nos. 4,863,412 and 5,383,805. This type of hook mechanism releases the rubber band as soon as the speed of the glider exceeds that of the contraction of the rubber band. This type of launching is similar to shooting an arrow, whereby the trajectory of the free flying airplane is determined by the aiming of the user. Because of the limited length of the user's arms, this type of launching system utilizes only a short rubber band and no tow string. Therefore, it can propel the flying toy to a relatively low height, and speed, compared to more complex towing systems.

Another method to launch a toy car or a toy airplane is given in U.S. Pat. No. 5,433,641. It uses the force of two strings being pulled apart by a sudden lateral movement of the user's hands and since the toy is riding both strings and a rigid rail, it is propelled forward along the rail. This launching method can propel a car toy for only a few feet on the floor or make a toy airplane reach only a few feet in height thus having the same limitations mentioned in the previous paragraph. To launch a model glider you may need to attain several hundred feet in height before the gliding free flight can begin. Another disadvantage of this launch method is that it does not have a tow release mechanism that controls the flight attitude of the toy airplane while it is climbing; the attitude of the toy airplane is controlled only while it is riding the short rigid rail.

Another use of strings to launch a toy airplane or a toy missile is given in U.S. Pat. No. 2,638,708. It uses a hand-held handle that has a rotating disc with two strings attached to it and with the other ends of the two strings attached to a small rotating element inside the toy to be launched. By whirling the toy, a centrifugal force is imparted to it until a large velocity is achieved, similar to the traditional sling and stone launcher. To release the missile from the strings, the position of a trigger lever is changed in the hand held handle which stops the disc from rotating and this in turn changes the relative angular position of the two strings. At the other end of the two strings this creates a corresponding rotational movement in the small rotating element inside the missile causing the small rotating element to become detached from the toy airplane leading to its release from the two strings.

A disadvantage of this launching method and its release mechanism is that in order to whirl around the flying toy, it must use short strings of a few feet in length; thus the flying toy is released at a height of only a few feet; it is not possible to whirl around a model glider with long strings and make it reach a height of several hundred feet before the release mechanism detaches the strings so that it starts its free gliding flight. Another disadvantage is that this string release mechanism uses two strings, so if they were several hundred feet long, they would entangle easily causing a differential elongation that causes errors in the angular position of the release mechanism leading to an inaccurate release.

An advantage of the presently proposed release mechanism over this centrifugal launching method and string release mechanism, is that it can be used in connection with a single string tow line to tow the model glider to several hundred feet in height. This avoids the use of the heavier two string system and avoids the problem of having two very long lines becoming entangled and differentially elongated causing errors in the angular positions of the release mechanism causing an inaccurate release.

It is for this reason, that the "State of the Art" launching method for model gliders, known commercially as "Hi-start" is preferred. It is a tow system made up with a single long elastic element, such as a rubber-band or latex tube, tied to an even longer single tow line, such as a nylon fishing line, with a total length of 200 to 300 feet. The end of the rubber-band is attached to a ground stake and the end of the tow line is attached to small steel ring. To launch a model glider, the steel ring is inserted into a single hook located on the body of the model glider; then the user walks several feet stretching the latex tube to its elastic limit. When the user lets the glider be pulled by the elastic element-tow line system it will rise gradually to several hundred feet in height. As mentioned before, the disadvantage of the single hook tow release system used in the "High-start" method is that it can not control automatically the fuselage angle during the climbing phase; this can easily cause a wing stall or a premature release before the maximum height is reached. It is the objective of the present automatic tow release system to overcome this difficulties.

The use of a long tow line is desirable for launching model airplanes, even if they are not equipped with radio control, because of the great height it provides. In such cases, however, the use of a simple ring-and-hook connection results in a tow system that does not release consistently at the desired height, speed, and flight path angle. The fuselage's climb angle during take-off depends strongly on the relative air speed over the glider. This, in turn, depends on the wind speed, wind direction, and the amount of stretch given to the elastic band, or the speed of the winch. Furthermore, a tow system, comprising a simple tow hook and a tow ring, does not sense the fuselage's climb angle with respect to the ground, therefore such a tow system can not be pre-set to release the tow line when the glider is in the optimum position and speed to initiate the longest possible glide. These release conditions occur when the glider is at the maximum possible height, with its speed near its gliding speed, and with the fuselage in an almost horizontal position. What typically happens when one attempts to launch a non-radio-controlled airplane in this fashion is that the plane releases prematurely at a relatively low height, and high speed, with its fuselage in an almost vertical position. As a result, it either makes a loop upon release and thereafter it quickly lands, or it dives and crashes.

Consequently, for model planes with no radio control, it is very important to have an automatic tow release system. The user of such system could predetermine the height, at which he or she wishes the airplane to disengage from the tow line. For the longest possible free flight, the glider would release at maximum height. For a loop, it would release at a sufficient height to avoid a crash and while it is still in the accelerating climbing position.

SUMMARY OF THE INVENTION

Accordingly, it is an object of the present invention to provide an automatic tow release system for model aircraft launched by a tow line which comprises novel means for (a) automatically sensing the climb angle of the fuselage, and the angle of the tow line relative to the ground, (b) continuously and automatically adjusting the climb angle of the fuselage to the appropriate level based on the tow line angle, in order to avoid a premature release or a wing stall, and (c) automatically releasing the tow line when the aircraft reaches a predetermined climbing position.

Another object of the present invention is to provide a low-cost, reliable automatic tow release system for model aircraft which does not rely on radio control or time delay mechanisms, and comprises no complicated moving parts.

Still another object of the present invention is to provide an automatic tow release system which can be set to release the aircraft in optimum position for a slow gliding flight or for a quick loop, depending on the user's intention.

In keeping with these objects, and with others which will become apparent hereinafter, some features of the preferred embodiment of the present invention reside, briefly stated, in an automatic tow release system, comprising a primary and a secondary control string, both are connected to the tow line at one end and to a connecting body at the other end; a primary and a secondary hook, both are attached to the connecting body; and a primary and a secondary hook receptacle, both are installed on the bottom of the fuselage. The primary and secondary hooks are connected to the primary and secondary hook receptacles, respectively, during towing.

Other important features of the preferred embodiment are that the primary and secondary hooks are installed near the rear and front ends of the connecting body, respectively; and the primary control string is connected to the connecting body below the primary hook, while the secondary control string is connected to the connecting body below the secondary hook. Consequently, when the pulling force of the tow line is conveyed mostly through the primary control string, it acts mainly on the primary hook. When the pulling force is conveyed mostly through the secondary control string, it acts mainly on the secondary hook.

Another feature of the present invention is that the geometry between the fuselage, the connecting body and the control strings is designed so, that the pulling force of the tow line is conveyed to the aircraft initially by the primary control string, and it is transferred gradually to the secondary control string as the glider is climbing.

Still another important feature of the present invention is that the design of the primary and secondary hooks comprises a means for triggering the release of the tow line when the pulling force is acting mostly on the secondary hook. In the preferred embodiment, this means is achieved by making the two hooks have different angles relative to the connecting body. Namely, the primary hook has an angle that is significantly smaller than the angle of the secondary hook. While the pulling force of the tow line is acting mostly on the primary hook, it cannot slide out of the primary hook receptacle because of its small angle. When the pulling force acts mainly on the secondary hook, the hook assembly is released.

Other features of the tow release system include that, because of its geometric design, it controls the climb angle of the fuselage throughout the tow, keeping the aircraft safe.

The novel features which are considered characteristic for the invention are set forth in particular in the appended claims. The invention itself, however, will be best understood from the following description of the preferred embodiment when read in connection with the accompanying drawings.

BRIEF DESCRIPTION OF THE DRAWING FIGURES

In the drawings, closely related figures have the same number but different alphabetical suffixes.

FIG. 5 illustrates the positions of the hooks inside their receptacles and the relative tension on the control strings in three different climbing positions (A–C) during a tow.

Figure 1:
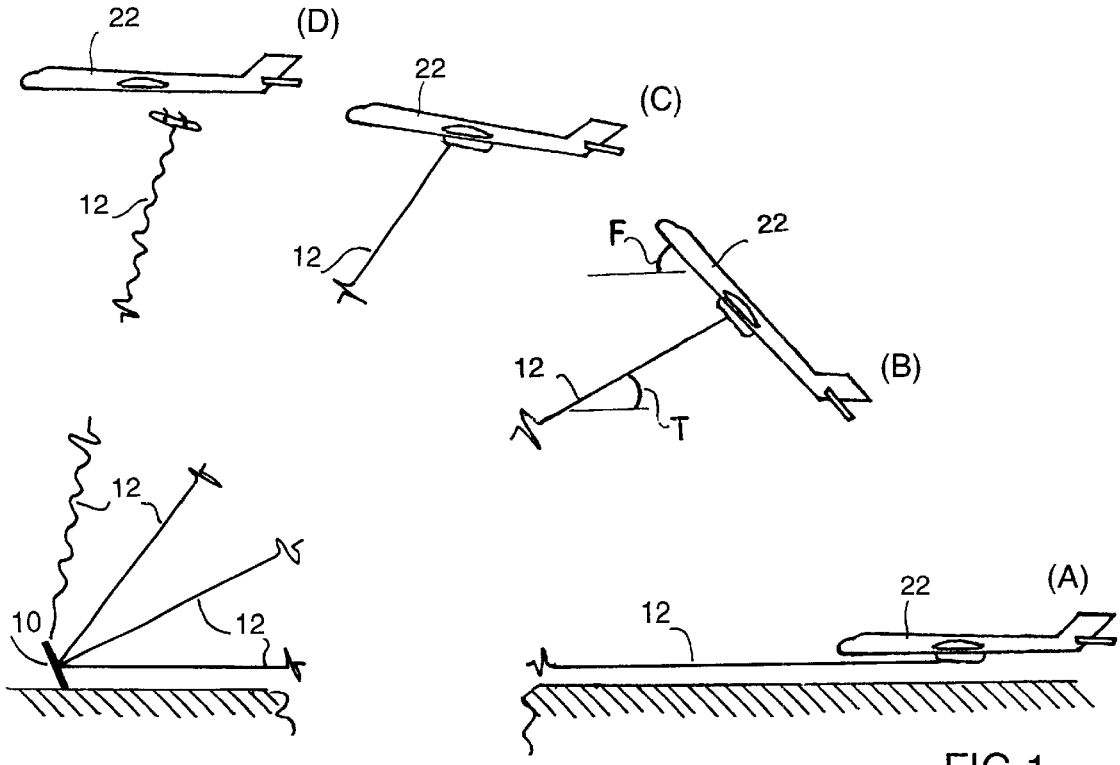
FIG. 1 shows simplified side views of a glider in four different climbing positions from take-off (A) to the release of the tow line (D).

| LIST OF REFERENCE NUMERALS USED IN THE DRAWINGS | |
|---|---|
| 10 | ground stake |
| 12 | tow line |
| 14 | ring |
| 15 | split ring |
| 16 | primary control string |
| 18 | secondary control string |
| 20 | connecting body |
| 22 | fuselage |
| 24 | wing |
| 26 | drag plate |
| 28 | primary string attachment point |
| 30 | secondary string attachment point |
| 32 | receptacle plate |
| 34 | primary hook receptacle |
| 36 | secondary hook receptacle |
| 38 | primary contact point |
| 40 | secondary contact point |
| 42 | primary hook |
| 44 | secondary hook |
| 46 | alternative primary string attachment point |
| 48 | alternative secondary string attachment point |
| 50 | receptacle tube |
| 56 | top holes in drag plate |
| 58 | bottom holes in drag plate |
| 62 | pivot |
| 64 | pivoting release bar |
| 66 | pivoting secondary hook |
| 68 | limiting bar |

DETAILED DESCRIPTION OF THE INVENTION

The automatic tow release system of the present invention offers novel means for controlling the fuselage's climb angle during the tow, and for releasing the tow line when the airplane has reached a predetermined climbing position.

FIG. 1 is presented to aid the description of the invention's operation and to clarify the terminology. The figure displays a simplified model glider in four stages (A–D) of an idealized take-off for a gliding flight, propelled by an elastic tow line 12. The figure is generalized, it does not show the components of the present invention.

As shown in the drawing, tow line 12 is typically attached to a ground stake 10 at one end, and to the glider's fuselage 22 at the other end. In the prior art, the latter connection has been generally made through a simple ring-and-hook mechanism (not shown in the drawing), with the hook being on the bottom of fuselage 22.

Throughout the description the angle between the long axis of fuselage 22 and the horizontal ground will be referred to as climb angle F of the fuselage, as shown in panel (B) of FIG. 1. The angle between-tow line 12 and the horizontal ground will be referred to as tow angle T, also shown in panel (B) of FIG. 1.

The take-off starts in position (A), with both fuselage 22 and tow line 12 in a practically horizontal position. In other words, climb angle F and tow angle T are both near 0 degrees. Tow line 12 is stretched to provide appropriate tension. As a result, the glider takes off at a high speed and, in just a few seconds, it assumes a typical climbing position illustrated in panel (B). During the climb, positions (B) and (C), tow angle T increases continually from 0 degrees towards 90 degrees. Climb angle F also increases from 0 degrees, but it reaches a maximum value of about 45 degrees, after which it decreases again, approaching 0 degrees as the glider nears its maximum height. At maximum height, T is about 90 degrees, and F is close to 0 degrees. When the glider is in the best gliding position, shown in panel (D), tow line 12 is released. A similar take-off is achieved when a non-elastic, mechanically propelled tow line is used.

It is difficult to realize the take-off pattern illustrated in FIG. 1 when non-radio-controlled gliders are launched. The tow hook is more likely to slide out of the tow ring when the aircraft is still in or around position (B), forcing the plane to continue its flight in a loop, instead of a smooth glide.

Figure 2A:
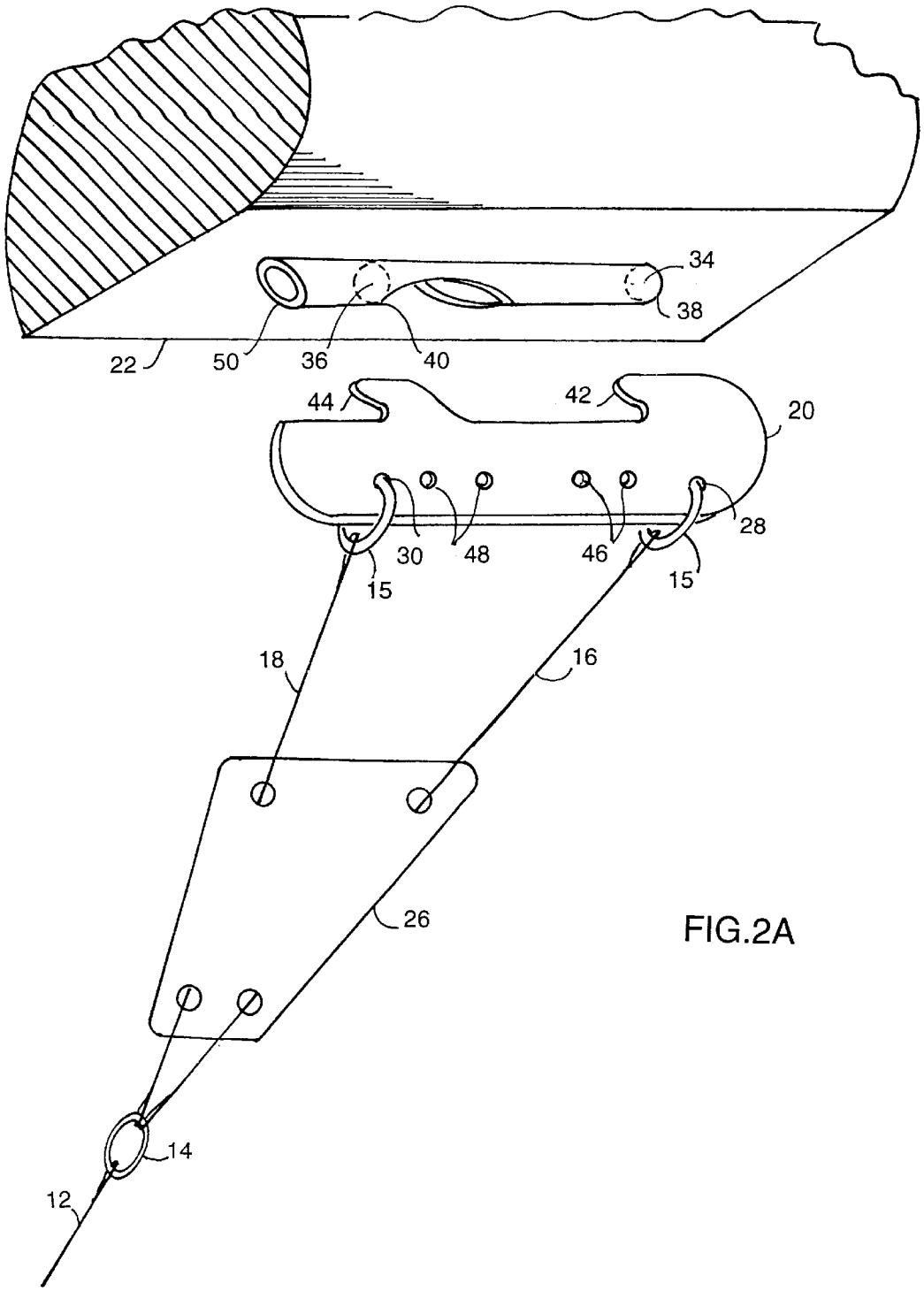
FIG. 2A is a perspective view of the components of the automatic tow release system when a hook receptacle tube is used.
Figure 2B:
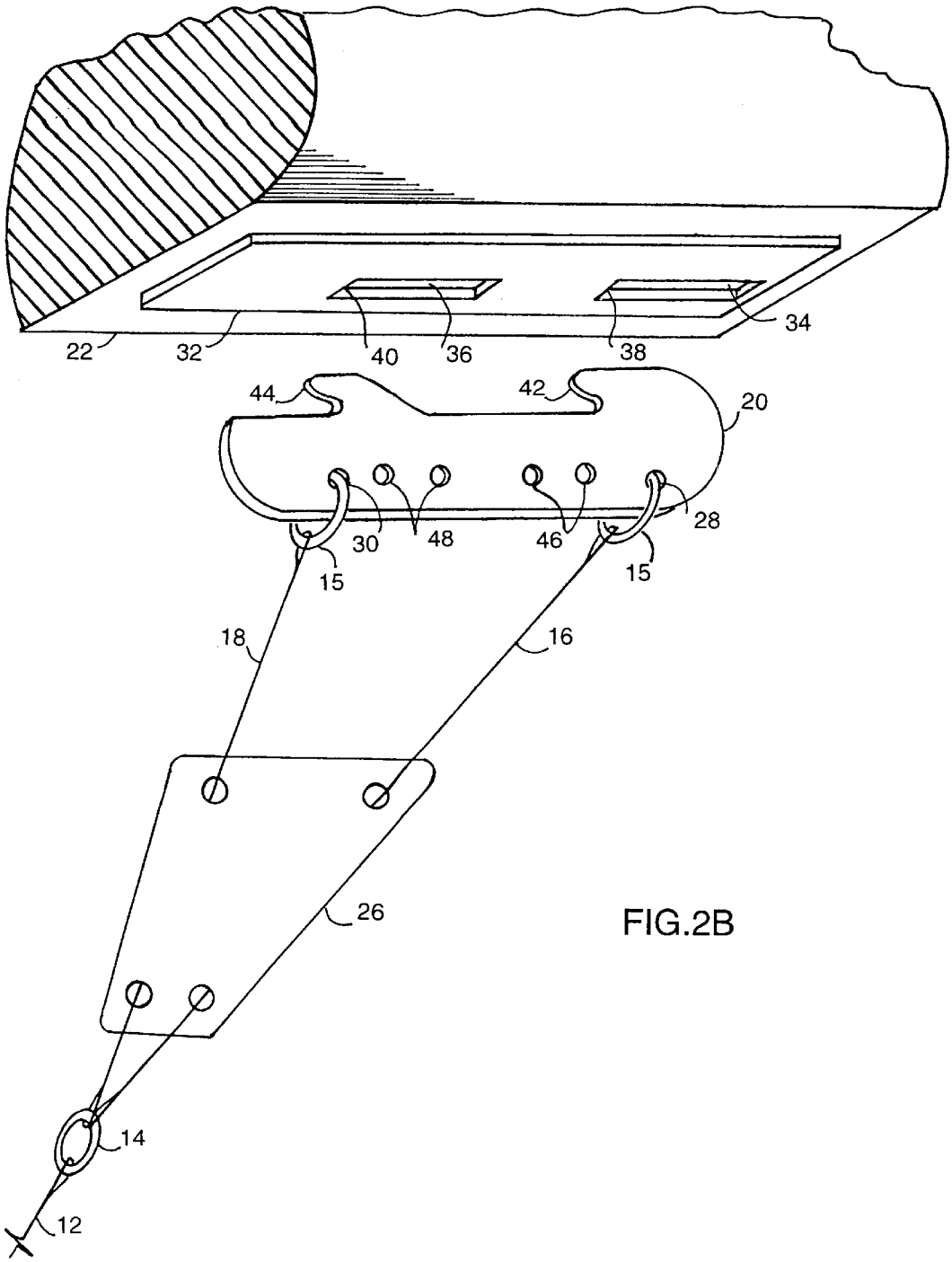
FIG. 2B is a perspective view of the components of the automatic tow release system when a hook receptacle plate is used.

To circumvent this problem, the present invention introduces an automatic tow release system that is demonstrated in detail in FIGS. 2A and 2B. The figures show similar perspective views of two slightly different versions of the preferred embodiment of the automatic tow release system. Tow line 12 terminates in two separate control strings, a primary control string 16 and a secondary control string 18. Primary control string 16 is somewhat longer than secondary control string 18, by design. Both control strings are connected to tow line 12 at the same connection point through a small ring 14. The control strings then go through a drag plate 26. The other ends of the control strings are attached to a rigid connecting body 20. Primary control string 16 is connected to connecting body 20 at primary string attachment point 28, while secondary control string 18 is connected to connecting body 20 at secondary string attachment point 30 through a couple of small split rings 15, respectively. Connecting body 20 has several alternative primary string attachment points 46 and secondary string attachment points 48. Split rings 15 make it easy to shift the control strings from their main attachment points to their alternative attachment points. The primary string attachment points 28 (46) are located near the posterior end of connecting body 20, while secondary string attachment points 30 (48) are located near the anterior end of connecting body 20. The relative lengths of the two control strings are set up so that the length of primary control string 16 is greater than the length of secondary control string 18, but the cumulative length of secondary control string 18 and the distance between the two string attachment points is greater than the length of primary control string 16.

Two tow hooks are installed on the top of connecting body 20: a primary hook 42 is positioned near primary string attachment points 28 (46), while a secondary hook 44 is positioned near secondary string attachment points 30 (48). The bottom of fuselage 22 is equipped with a primary hook receptacle 34 to accommodate primary hook 42, and a secondary hook receptacle 36 to accommodate secondary hook 44. In the preferred embodiment shown in FIG. 2A, the hook receptacles are provided by an externally located receptacle tube 50. In the alternative preferred embodiment shown in FIG. 2B, the hook receptacles are internal to fuselage 22 and they are reinforced by an external receptacle plate 32. When properly engaged during a tow, primary hook 42 transfers the towing force to primary hook receptacle 34 at primary contact point 38, and secondary hook 44 transfers the towing force to secondary hook receptacle 36 at secondary contact point 40. Both hook receptacles are large enough to allow the hooks some vertical rotational movement around their respective contact points, as well as some tilt sideways.

Figure 3:
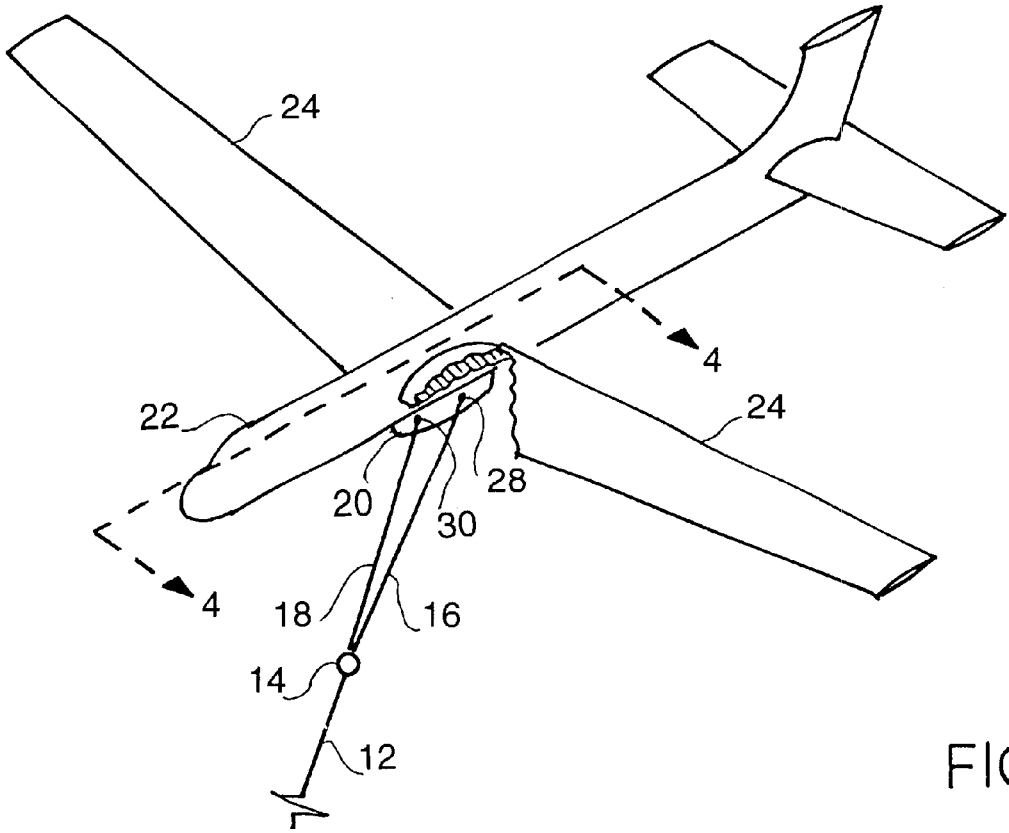
FIG. 3 is a perspective view of a typical glider showing the approximate position of the automatic tow release system with respect to the fuselage.

FIG. 3 is a perspective view of a typical glider and it shows the position of the automatic tow release system with respect to fuselage 22.

Figure 4A:
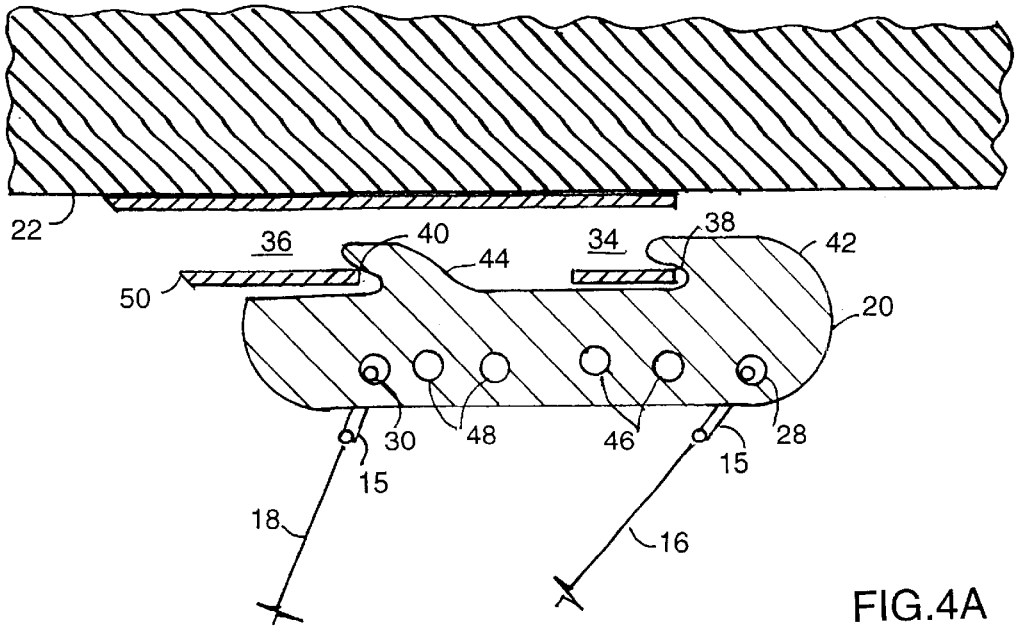
FIG. 4A is a cross section along line 4—4 of FIG. 3, showing the hooks on the connecting body and the matching hook receptacles that are provided in the form of a receptacle tube.
Figure 4B:
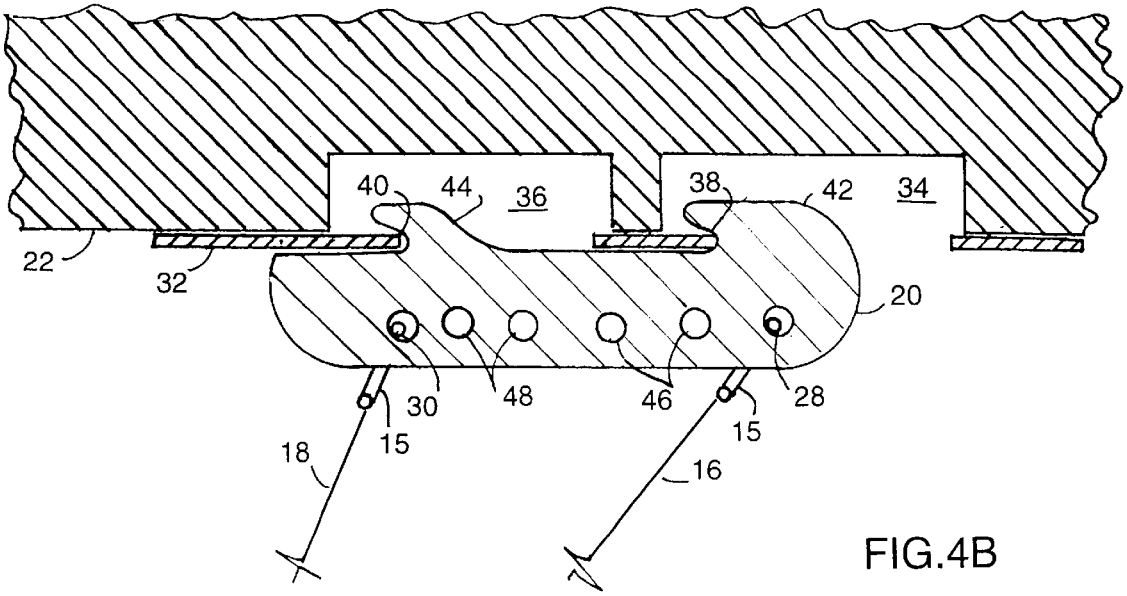
FIG. 4B is the same as FIG. 4A, except here the hook receptacles are recessed into the fuselage and reinforced by a receptacle plate.

FIG. 4A shows a cross section of the automatic tow release system along line 4—4 of FIG. 3, when external receptacle tube 50 is installed on fuselage 22. FIG. 4B shows the same but the hook receptacles are inside fuselage 22, reinforced externally by receptacle plate 32. The figures show the tow hooks engaged in the hook receptacles. Two important features of the invention are noticeable in these drawings. First, the profiles of the two tow hooks have different angles relative to connecting body 20. In particular, the angle of primary hook 42 (about 5 degrees) is smaller than the angle of secondary hook 44 (about 25 degrees in this configuration). The other important feature is that the distance between primary hook receptacle 34 and secondary hook receptacle 36 is, by design, somewhat greater than the distance between primary hook 42 and secondary hook 44. Both of these features are essential for the operation of the tow release system.

Every component of the automatic tow release system is easy to manufacture, install, and use. They are all subjected to significant pulling forces during the tow, so their materials and designs should be chosen so that they are able to withstand these forces without breaking or losing their shapes. The control strings can be prepared from commercially available strings made of nylon or similar reasonably tear-resistant non-elastic material. They can be connected to the tow line by a simple knot, however, it is advisable that a small connecting member, such as ring 14 shown in FIGS. 2A and 2B, be used. The presence of ring 14 makes it easier to adjust the lengths of the control strings. The connecting body can be made of several different types of material. In the preferred embodiment, the flat connecting body is made of clear polycarbonate plastic and it forms an integral piece with the tow hooks. The connecting body and the hooks can also be manufactured separately, and of different materials. The base can be metal, wood, plastic, etc. The hooks should have low-friction surfaces, so that they can slide out of the hook receptacles easily. Rigid metal or rigid plastic is recommended. The receptacle tube and receptacle plate can also be manufactured of polycarbonate plastic or other material with similar strength. The drag plate can be cut out of an about 0.2 mm (0.01 inch) mylar sheet, or other material with similar characteristics.

The only components of the tow release system that need to be physically installed on a glider are the primary and secondary hook receptacles. Receptacle tube 50 of the preferred embodiment was designed to facilitate the installation of the automatic tow release system on existing gliders. The tube can be easily attached to the bottom of the glider, preferably by strong adhesive means. A great advantage of using a receptacle tube instead of two discrete hook receptacles is that the distance between the two hook receptacles is fixed by the dimensions of the tube, and the user who does the installation does not have to worry about this important parameter.

When the hook receptacles are installed during the manufacturing process of a glider, they can be made internal to the fuselage. This configuration reduces the aerodynamic drag on the glider during flight. To reinforce the edges around the internal hook receptacles, receptacle plate 32 can be externally installed on the bottom of the fuselage by adhesive means. Internal hook receptacles can be added to existing gliders as well, especially when the fuselage is made of plastic foam material. The user him/herself can easily install receptacle plate 32 and carve two indentations into the soft material inside the slits of receptacle plate 32. A further advantage of this configuration is that all the major components of this preferred embodiment (excluding the control strings) can be manufactured by being stamped out of flat sheets of the appropriate material. This makes the-automatic tow release system quite elegant and economical at the same time.

The general operation of the automatic tow release system can be briefly summarized as follows. The tension of the tow line is split into two separate pulling forces through the two control strings (16, 18). The pulling forces are conveyed to the glider through the rigid connecting body (20). The connecting body has two connecting means with the glider, each making a contact point (38, 40), where the pulling forces are transferred to the glider. In the preferred embodiment, the connecting means are two hooks (42 ,44) on the connecting body and two corresponding hook receptacles (34, 36) on the bottom of the fuselage. Because of the geometry of the assembly, the pulling force of the primary control string (16) acts mainly on the primary contact point (38), while the pulling force of the secondary control string (18) acts mainly on the secondary contact point (40).

The design of the automatic tow release system comprises a release promoting means which facilitates the disengaging of the connecting means when the pulling force is concentrated in the secondary control string and there is little or no tension in the primary control string. In the preferred embodiment, the release promoting means is the arrangement wherein the profiles of the two hooks have different angles relative to the horizontal. Namely, the primary hook has an angle that is significantly smaller than the angle of the secondary hook. While there are pulling forces on the primary hook, it cannot slide out of the primary hook receptacle because of its close-to-zero angle at the primary contact point. When nearly all the pulling forces are transferred to the secondary hook, the hook assembly is released. Due to the geometric relationship between the fuselage, the connecting body and the control strings, the tension of the tow line is conveyed to the aircraft initially through the primary control string, and it is transferred gradually to the secondary control string as the glider is climbing.

A more detailed description of the operation of the preferred embodiment can be given with the help of FIG. 5.

The figure has three panels (A)–(C) that show a cross section of the engaged tow assembly during three stages of a take-off, respectively. Control strings shown with straight lines are conveying pulling forces, while wavy control strings have no tension on them.

Panel (A) of FIG. 5 depicts the beginning of the tow when tow angle T and climb angle F (as defined in FIG. 1) are both near zero degrees. Panel (B) shows an intermediate step during the climb when both T and F have values between 0 and 90 degrees. Finally, panel (C) depicts the moment when the glider is in optimum position to start a smooth gliding flight, with T close to 90 degrees and F close to 0 degrees.

As mentioned previously, the relative lengths of the two control strings are set up so that the length of primary control string 16 is greater than the length of secondary control string 18, and the cumulative length of secondary control string 18 together with the distance between the two string attachment points is greater than the length of primary control string 16. Consequently, when T is close to 0 degrees, there is a strong tension on primary control string 16, and little or no tension on secondary control string 18, so connecting body 20 is forced to rotate a bit clockwise around primary contact point 38. As a result, secondary hook 44 does not touch secondary contact point 40. The tow assembly touches the glider only at primary contact point 38. The tension of primary control string 16 produces strong friction forces at primary control point 38. Due to the strong friction forces and to the small angle of primary hook 42, primary hook 42 cannot slide out of its receptacle.

While the glider is climbing and T is moving from 0 to 90 degrees (panel (B) of FIG. 5), the tension of the tow line is being gradually transferred from primary control string 16 to secondary control string 18. Meanwhile, there is enough tension on primary control string 16 to produce the amount of friction at primary contact point that is needed to keep the tow assembly from disengaging.

When T approaches 90 degrees, there is a strong tension on secondary control string 18 and little or no tension on primary control string 16. Secondary hook 44 is forced to make contact with secondary hook receptacle 36 at secondary contact point 40. At the same time, the friction forces on primary contact point 38 are greatly reduced by the fact that there is little tension on primary control string 16. Because of the larger angle of secondary hook 44, the near vertical direction of the strong pulling force conveyed by secondary control string 18 forces secondary hook 44 to slide backward. This outweighs the friction forces on both contact points, and the hooks slide out of their receptacles and the tow assembly is released.

Figure 6:
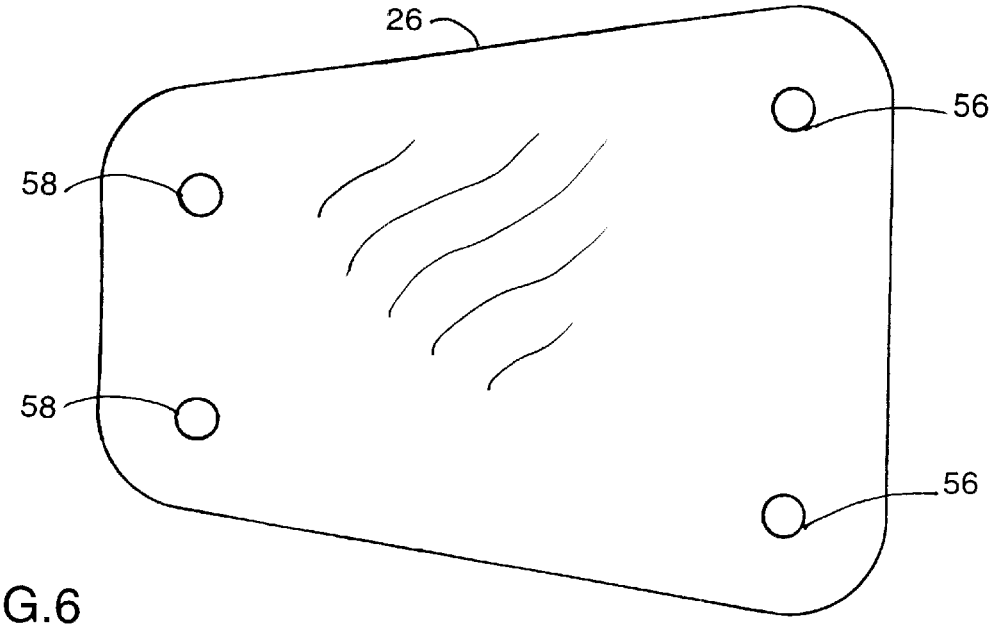
FIG. 6 is a plan view of the recommended drag plate.

The release is further facilitated by the vibration of the drag plate whose plan view drawing can be seen in FIG. 6. The drag plate is made of non-elastic sheet material and it is designed to have a relatively large surface. A pair of top holes 56 and a pair of bottom holes 58 are provided for installing the drag plate on the control strings. The installed drag plate can be seen in FIGS. 2A and 2B. The drag plate serves three main purposes. First, it prevents the two control strings from becoming entangled during the tow. Second, because of its aerodynamic drag, it induces small vibrations in the tow assembly which makes it easier for the hooks to slide out of their receptacles. Third, it reduces the falling speed of the released tow assembly.

Besides disengaging the tow line at the appropriate position, the automatic tow release system also keeps climb angle F of the fuselage in proper position during the tow. During a very high-speed take-off or during a gust of the glider intends to raise its nose, increasing the value of F. This, however, enhances the pulling force of forward located secondary control string 18. The increased force of the secondary control string counteracts the tendency of fuselage 22 to tilt up, limiting the value of F to within a safe range, so that a wing stall is avoided. The glider is not released until the predetermined value of T is reached.

The above description of automatic tow release system's operation was limited to the release at optimum condition for a slow gliding flight. In the authors' opinion, this would be the main use of the invention since it produces beautiful, long lasting free flights. However, the user has the freedom to change some parameters on the tow release system so that the aircraft is released while it is still in a high-speed climbing position, as depicted in panel (B) of FIG. 1. Under these release conditions, the glider will climb vertically and loop backward, then descend in a fast dive and gradually attain a horizontal level flight before landing. Since the release is triggered by the pulling forces being transferred to the secondary control string, changes that will make this transfer happen at an earlier stage in the climb will result in an earlier release. The user should move primary control string 16 to a more forward located alternative primary string attachment point 46 and shorten the length of secondary control string 18. Furthermore it is recommended that the angle of secondary hook 44 be increased to about 45 degrees. (When the automatic tow release system is marketed, it is feasible to include two connecting body-hook components with different secondary hook angles.) These changes will not only facilitate an earlier release, but also allow for a much larger climb angle F at the time of the release. This is beneficial for a looping flight.

The exact dimensions of the ideal configuration of the automatic tow release system depend on the type of flying object it is used on, and the desired speed of the take-off. Once the dimensions are optimized for a particular flight pattern on a particular aircraft, the automatic tow release system works with great reliability and reproducibility. A tow system that uses a single loop and hook connection is not reliable, since the timing of its release depends on the angle the fuselage makes with the tow line. This angle, in turn, depends on the prevailing wind speed and the tension force of the tow line. Because the operation of the automatic tow release system is based on its geometric design, the timing of its release is much less disturbed by external parameters.

Besides its great reliability, the beauty of the automatic tow release system is in its very simple design. Every component of the preferred embodiment (excluding strings) can be manufactured from plastic sheets by a simple cutting press. This makes the manufacturing process very fast, efficient, and economical. Since the preferred embodiment has no mechanically moving parts which could break down, it has an extremely long useful lifetime.

While the above description contains many specificities, these should not be construed as limitations on the scope of the invention, but rather as an exemplification of one preferred embodiment thereof. Many other variations are possible.

For instance, the connecting means between the connecting body and the aircraft can have different manifestations. An example would be placing the hooks on the aircraft and the receptacles on the connecting body. It should be noted that on most existing towing systems, the single hook is located on the fuselage and the receptacle loop is at the end of the tow line. When such an aircraft lands, the nonretractable hook hits the ground which has numerous undesirable consequences. This is why, contrary to prior art, the preferred embodiment has the hooks on the tow line. The connecting means can have a design that is not based on a hook. Any configuration is acceptable as long as the connection is strong enough to, withstand the tension forces of the towing, and it can be triggered to release the tow assembly when the tension is transferred from a primary control string to a secondary control string.

Figure 7:
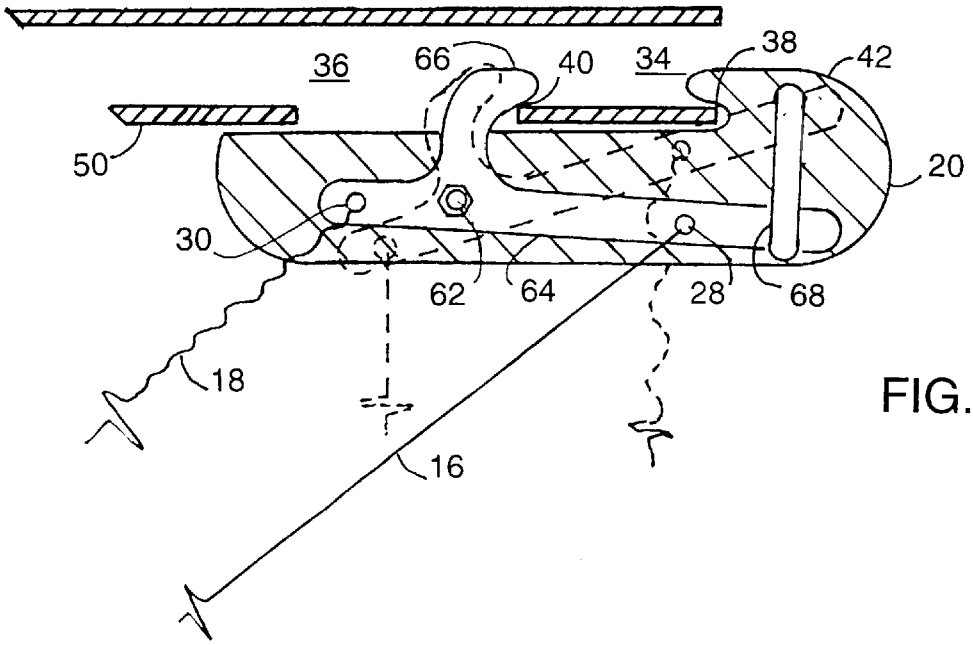
FIG. 7 is a schematic cross section of an alternative embodiment of the automatic tow release system.

The release promoting means, which is activated upon the transfer of pulling forces from the primary to the secondary control string, can also have different manifestations. One example is shown schematically in FIG. 7. which depicts the cross section of an alternative embodiment of the automatic tow release system. In this configuration, the secondary hook is replaced by a pivoting release bar 64 which is attached to connecting body 20 through a pivot 62. The upper portion of pivoting release bar 64 terminates in a pivoting secondary hook 66 which is facing backward. Primary and secondary control string attachment points, 28 and 30, respectively are now located on pivoting release bar 64. The pivoting motion of pivoting release bar 64 is limited by a limiting bar 68. While there is tension on primary control string 16, pivoting release bar 64 is kept in the position shown with a solid line in the drawing. When the pulling force is transferred to secondary control string 18, pivoting release bar 64 rotates to the position shown with a dashed line in the drawing. In this position, pivoting secondary hook 66 moves out of secondary hook receptacle 36 and the tow assembly is released. Other similar configurations are conceivable, although they lack the elegant simplicity of the preferred embodiment.

When a single tow assembly is used, it is practical that it be connected to the bottom of the aircraft's fuselage for stability. On flying toys with different shapes the tow assembly can be connected to any appropriate part that yields an aerodynamically stable arrangement. One could connect more than one tow assembly to the same flying object. For example, on a model aircraft with two wings, one could attach two separate tow assemblies on the bottom of the two wings, respectively. The embodiment of each individual tow assembly would be as depicted in FIG. 2A, with the exception that receptacle tube 50 would be attached to the bottom of a wing of the airplane instead of fuselage 22. The arrangement could be designed so that the receptacle tubes resemble jet engines on the airplane. The release of the tow line would happen as described previously, assuming that the two identical tow assemblies would disengage simultaneously when the desired climb angle is reached. Both tow assemblies would be connected to the same tow line and they would be of equal length. This arrangement, besides controlling the climb angle F, would provide additional lateral stability to the aircraft.

The automatic tow release system of the present invention can be used in connection with any aerodynamically stable flying toy that is launched in connection with a tow line. For example, the flying toy could be shaped as a natural creature, such as a flying bird, whereby the body of the bird would correspond to the fuselage of the airplane (shown in the drawings); and the wings of the bird would correspond to the wings of the airplane (shown in the drawings). Alternatively, the flying toy could be shaped as a fictional character, such as a human figure with a wing shaped cape, whereby the body of the human figure would correspond to the fuselage of the airplane (shown in the drawings); and the cape of the human figure would correspond to the wings of the airplane (shown in the drawings).

The shape and size of any component of the automatic tow release system can vary from the preferred embodiment, as long as it can perform its original function. Accordingly, the scope of the invention should be determined not by the examples given, but by the appended claims and their legal equivalents.

What is claimed is:

1. An automatic tow release system that can be used in combination with a model airplane or other flying toy launched in combination with a tow line comprising (a) a primary and a secondary control string;

(b) a connecting body;

(c) a primary and a secondary connecting means between said connecting body and said model airplane or flying toy; and (d) a release promoting means;

wherein said primary control string is attached to said tow line at one end and to a primary string attachment point on said connecting body at the other end; said secondary control string is attached to said tow line at one end and to a secondary string attachment point on said connecting body at the other end; said primary string attachment point is located in the relative proximity of said primary connecting means; said secondary string attachment point is located in the relative proximity of said secondary connecting means;

said connecting body is substantially rigid; said connecting body is demountably connected to said airplane or flying toy during the tow through said primary and secondary connecting means, respectively;

said release promoting means is a feature of the design of said tow release system; the arrangement of said primary and secondary control strings is such that the tension of said tow line is carried by said primary control string at the beginning of the tow, and said tension is gradually transferred to said secondary control string as said airplane or flying toy is ascending; said release promoting means is activated upon the transfer of said tension to said secondary control string, whereby said primary and secondary connecting means are disengaged.

2. An automatic tow release system as defined in claim 1, wherein said primary and secondary connecting means comprise a primary and a secondary hook, respectively, mounted atop said connecting body, and a primary and a secondary hook receptacle, respectively, mounted on said airplane or flying toy.

3. An automatic tow release system as defined in claim 2, wherein said release promoting means is the arrangement wherein the angle of said secondary hook relative to the horizontal is greater than the angle of said primary hook relative to the horizontal.

4. An automatic tow release system as defined in claim 3, further including a drag plate mounted on said primary and secondary control strings, respectively; said drag plate inducing vibrations in said primary and secondary control strings, said vibrations aiding the disengaging of said primary and secondary hooks.

5. An automatic tow release system as defined in claim 2, wherein said connecting body is manufactured as an integral piece of uniform material with said primary and secondary hooks.

6. An automatic tow release system as defined in claim 1, wherein said flying toy is shaped as a natural creature.

7. An automatic tow release system as defined in claim 1, wherein said flying toy is shaped as a fictional character.

8. The automatic tow release system of claim 1, wherein a plurality of said automatic tow release systems is used on said airplane or flying toy, said plurality of automatic tow release systems is positioned symmetrically on said airplane or flying toy.

9. The automatic tow release system of claim 1, wherein said primary connecting means is a hook mounted on said connecting body and a corresponding primary hook receptacle mounted on said airplane or flying toy; said release promoting means is a pivoting release bar attached to said connecting body through a pivot; and said secondary connecting means is a pivoting hook mounted on said pivoting release bar and a corresponding secondary hook receptacle mounted on said airplane or flying toy; said hook and said pivoting hook forming a semi-closed loop when engaged; said primary and secondary string attachment points are located on said pivoting release bar in an arrangement such that tension in said primary control string keeps said loop closed and tension in said secondary control string opens said loop, whereby said connecting body is released.

* * * * *